US005331868A

United States Patent [19]

Elmore

[11] Patent Number: 5,331,868

[45] Date of Patent: Jul. 26, 1994

[54] CRESCENT WRENCH

[76] Inventor: Thomas Elmore, 21811 NW. 6th St., Pambroke Pines, Fla. 33029

[21] Appl. No.: 100,291

[22] Filed: Aug. 2, 1993

[51] Int. Cl.[5] ..... B25B 13/16

[52] U.S. Cl. ..... 81/165; 81/145

[58] Field of Search ..... 81/155, 165, 166, 167, 81/142, 145, DIG. 3, DIG. 5

[56] References Cited

U.S. PATENT DOCUMENTS 2,722,150 11/1955 Green ..... 81/165

4,326,436 4/1982 McGraw ..... 81/165

*Primary Examiner*—D. S. Meislin

*Attorney, Agent, or Firm*—Malloy & Malloy

[57] ABSTRACT

A wrench including a main body having an elongate handle portion and a head portion, the head portion including a fixed primary jaw with a fixed grasping face and a pair of spaced, parallel track segments extending from the fixed grasping face, the track segments being spaced apart from one another so as to define a central channel therebetween. A pair of parallel slide faces on the secondary jaw slidingly and matingly confronting the parallel track segments, and at least one of the parallel slide faces including a vertical bore extending therethrough wherein a vertical spring is disposed, the vertical spring exerting an outwardly biasing force on a ballbearing disposed between the spring and the track segments, the track segment including a plurality of spaced recesses wherein the ballbearing is urged by the spring upon sliding of the secondary jaw along the track segment, the entry of one of the ballbearings into a recess resulting in removable locked engagement of the sliding secondary jaw in a predetermined position and a substantially audible sound being made so as to signal locked engagement at one of the plurality of recesses.

7 Claims, 1 Drawing Sheet

CRESCENT WRENCH

BACKGROUND OF THE INVENTION

1. Field of the Invention

The present invention relates to an adjustable wrench wherein the sliding jaw is lockingly engaged in one of a plurality of predetermined positions, the locking engagement being noticeable by a user without visual verification.

2. Description of the Related Art

Adjustable wrenches, often referred to as crescent wrenches, are a highly used and conveniently utilized tool. The reason for their convenient usage is the ability to vary the grasping dimensions of the wrench to meet specific needs. Traditionally, the spacing of the grasping faces of the wrench were adjusted by a worm gear disposed within a head portion of the wrench, the adjustment being visually made and finer adjustments necessarily waiting until positioning over the item to be grasped. Unfortunately, however, the adjustment process was often difficult and cumbersome especially when the wrench was utilized in hard to reach places, and had to be opened to release an item and readjusted to grasp an item of similar dimension. Fortunately, most screws, bolts, and the like are dimensioned in standard English or metric units which enables individual socket wrenches or permanently sized wrenches to be utilized. This sizing, however, does not benefit the use of an adjustable wrench because of the need to manually adjust its dimensions by visualization and comparison. As a result, it would be highly beneficial to provide an adjustable wrench which could be easily utilized with the standard dimensions.

In the past, there have been various adjustable wrenches which have attempted to allow locked engagement of the dimension or to facilitate visualization of the dimensions. Such adaptations include adaptations of pipe wrenches such as that disclosed in the reference to Cox, U.S. Pat. No. 4,580,468 and Baxter, U.S. Pat. No. 3,662,630, as well as adaptations of crescent type adjustable wrenches such as those disclosed in O'Quin, U.S. Pat. No. 3,376,767, Bonkowski, U.S. Pat. No. 2,850,932, Parnet, U.S. Pat. No. 2,369,072, Hose, U.S. Pat. No. 1,397,214, and McGraw, U.S. Pat. No. 4,326,436. These designs, however, while providing graded scales and providing for the locked engagement of the grasping jaws in a desired location, generally require complicated maneuvering and positioning, are not facilitated for use with only one hand, and are not readily adapted to identify locked engagement when used in difficult to reach locations wherein the spacing cannot be visualized and wherein due to the use of gloves or other circumstances, the locking in place cannot be easily felt. Still another important difficulty with regard to the recited variations, a difficulty which has minimized the widespread use of locking adjustable wrenches and maintain the need for an effective adjustable wrench, is the complicated manufacturing adaptation which must be undertaken in order to forge a wrench including the locking means. Adaptation of existing molds as well as the substantially increased labor required to put together a locking adjustable wrench of the type recited can significantly increase the cost of manufacturing, and accordingly buying a wrench, and can be more susceptible to such difficulties by a user who is not familiar with the functioning of the locking means. Additionally, the reference to Green, U.S. Pat. No. 2,722,150, utilizes a spring and ballbearing system to facilitate adjustability of the wrench jaws. The self-locking jaw wrench of Green, however, is adapted to directly engage the worm gear of the adjustable wrench and accordingly after prolonged use, may result in slippage making the set scale imprecise. Further, the wrench of Green as disclosed is not adapted to urge the ballbearing into a recess of sufficient depth so as to make a substantially audible sound, thereby further signalling positioning of the jaws at a predetermined spacing. Accordingly, there is still a need for an adjustable wrench such as that of the present invention wherein manufacturing adaptations are minimal, the dimensions will be significantly accurate as locking is determined directly between the stationary head portion and the sliding jaw rather than the sliding jaw and the rotating worm gear which is susceptible to slippage, and which enables tactile as well as audible identification by a user that the sliding jaw has locked into place at a desired predetermined distance.

SUMMARY OF THE INVENTION

The present invention relates to an adjustable wrench including primarily a main body with an elongate handle portion and a head portion. The head portion of the main body includes a fixed primary jaw and a pair of spaced parallel track segments. The fixed primary jaw includes a fixed grasping face with a distal segment and a proximal segment. Extending from the proximal segment are the spaced parallel track segments, each of which includes an upper slide face. The track segments are spaced from one another and define a central channel therebetween which extends into the head portion. Further included as part of the adjustable wrench is a sliding secondary jaw. The sliding secondary jaw includes a sliding grasping face with an upper segment and a lower segment. The lower segment of the sliding grasping face is substantially narrower than the upper segment of the sliding grasping face such that the lower segment is slidingly disposed between the track segment. Additionally included as part of the sliding secondary jaw is an elongate gear member. The elongate gear member extends tangentially from the lower segment of the sliding grasping face and is axially and slidingly disposed within the central channel of the head portion. The gear member is disposed such that sliding thereof within the channel will result in corresponding sliding of the secondary jaw along the track segments. Disposed along a bottom surface of the gear member are a plurality of gear teeth. These Tear teeth are adapted to be engaged by a worm gear disposed within the head portion. The worm gear is positioned such that rotation thereof will result in corresponding axial movement of the gear member and accordingly corresponding movement of the secondary jaw along the track segments. Included as part of the wider upper segment of the sliding grasping face are a pair of parallel jaw slide faces. The jaw slide faces are disposed on opposite sides of the lower segments of the sliding grasping face and are positioned so as to slidingly and matingly confront the upper sliding face of the parallel track segments. Disposed within the secondary jaw and extending through one of the jaw slide faces is a vertical bore. The vertical bore is adapted to receive therein a vertical spring. Additionally, a ballbearing is disposed between the vertical spring and the corresponding track segments, the vertical spring exerts an outwardly biasing force on the ballbearing so as to urge the ballbearing towards the track segment. Disposed within the corresponding one of the upper slide faces of the parallel track segments are a plurality of spaced recesses. The spaced recesses are spaced predetermined distances from one another and correspond to the spacing between the primary jaw and the secondary jaw. The recesses are adapted to receive partially therein the ballbearing upon slided positioning of the vertical bore atop one of the recesses. As a result of the outwardly biasing force of the spring on the ballbearing, and upon appropriate positioning of the vertical bore atop a designated recess, the ballbearing is urged within the recess resulting in removable locked engagement of the ballbearing within the recess and also resulting in a substantially audible sound being made, the substantially audible sound signalling locked engagement at one of the plurality of recesses.

It is a primary object of the present invention to provide an adjustable wrench which can be easily positioned in one of a plurality of predetermined, standardized jaw spacings.

A further object of the present invention is to provide an adjustable wrench which does not require visual recognition of the positioning of the sliding jaw at a desired spaced position due to removable locked engagement of the sliding jaw within the predetermined position.

Still another object of the present invention is to provide an adjustable wrench which will provide an audible sound to designate the positioning of the sliding jaw at one of a plurality of predetermined, desired positions, thereby eliminating the need to see or feel the engagement and positioning of the sliding jaw.

Another object of the present invention is to provide an adjustable wrench which requires minimal adjustment of existing adjustable wrench manufacturing molds.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
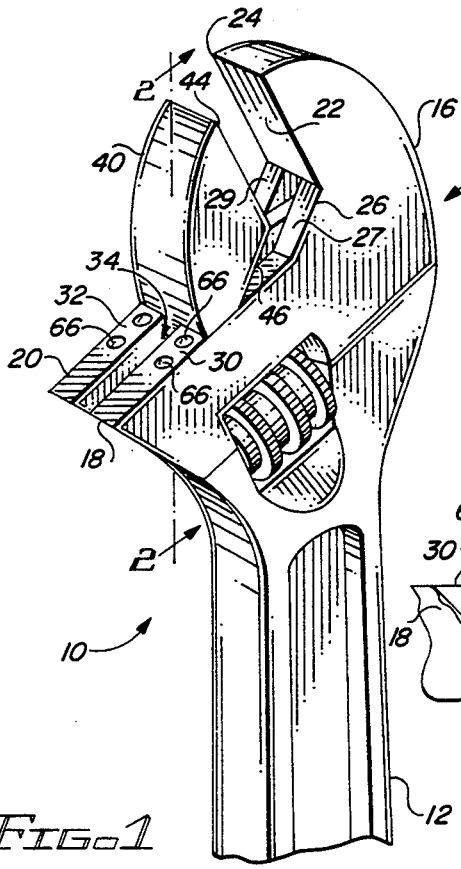
FIG. 1 is a perspective view in partial cutaway of the subject wrench assembly.
Figure 3:
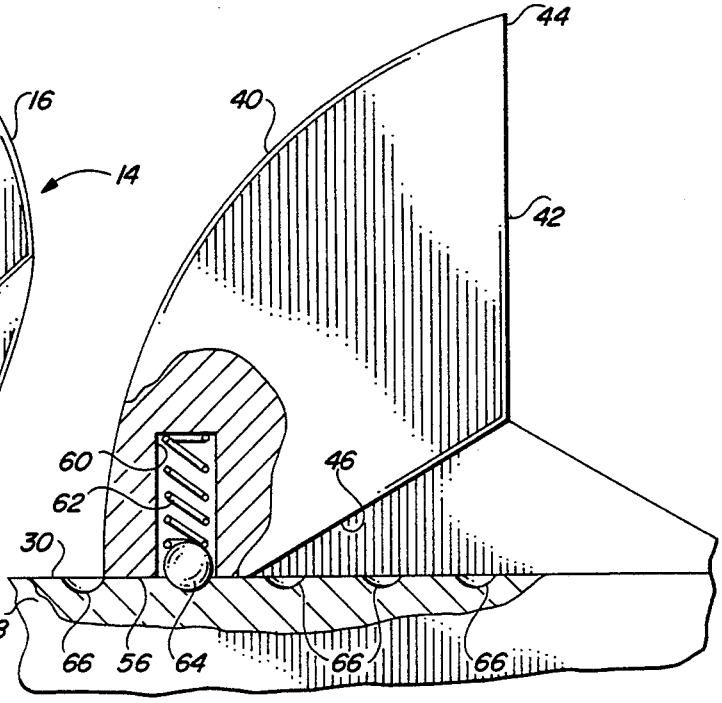
FIG. 3 is a detailed view in section and partial cutaway of components of the head assembly of the present invention.
Figure 2:
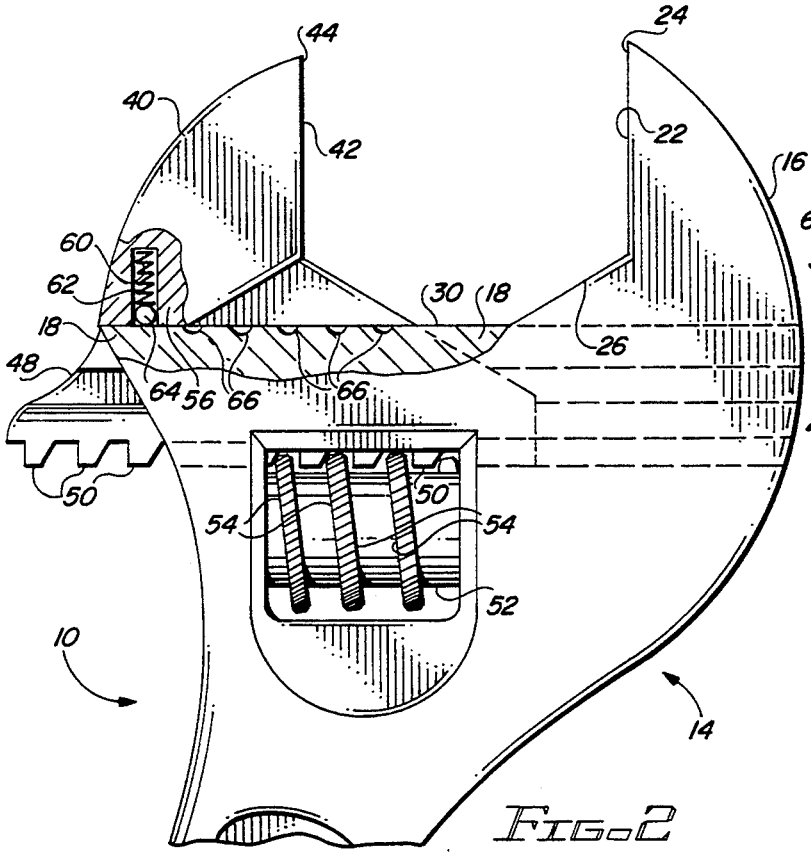
FIG. 2 is a sectional view taken along line 2—2 of FIG. 1 of a head portion of the present wrench assembly also in partial cutaway form.

Shown throughout the figures, the present invention is directed towards an adjustable wrench generally indicated as 10 to be utilized in the loosening and tightening of nuts and bolts of varying sizes as well as the gripping of pipes, nuts and the like of varying sizes. The adjustable wrench includes primarily a main body preferably formed of forged steel or an equivalent strong durable material. The main body is divided primarily into an elongate handle portion 12 and a head portion generally indicated as 14. The handle portion 12 may be of varying length so as to facilitate use of the wrench for differing application. The head portion 14 of the main body may similarly be of varying sizes. The head portion 14 of the main body includes a fixed primary jaw 16 and a pair of spaced parallel track segments 18 and 20. The fixed primary jaw has a fixed grasping face 22 which is divided into a distal segment 24 and a proximal segment 26. The distal segment 24 and the proximal segment 26 are preferably angled with relation to one another so as to accommodate adjacent sides of a bolt or screw as necessary. The pair of spaced parallel track segments 18 and 20 of the head portion 14 extend from the proximal segment 26 of the fixed grasping face 22. Further, the parallel track segments 18 and 20 are integrally formed with the proximal segment 26 and extend therethrough such that the proximal segment of the fixed grasping face 22 includes a pair of spaced parallel segments 27 and 29. The spaced parallel track segments 18 and 20 are disposed such that they are substantially perpendicular relative to the distal segment 24 of the fixed grasping face 22, the proximal segment 26 extending therebetween and being disposed at an angle relative to the distal segments 24 and the spaced parallel track segments 18 and 20. Each of the spaced parallel track segments 18 and 20 includes an upper slide face 30 and 32 respectively, and the track segments 18 and 20 are disposed so as to define a central channel 34 therebetween. The central channel 34 extends into the head portion 26 and includes a substantially cylindrical lower section 38.

Figure 4:
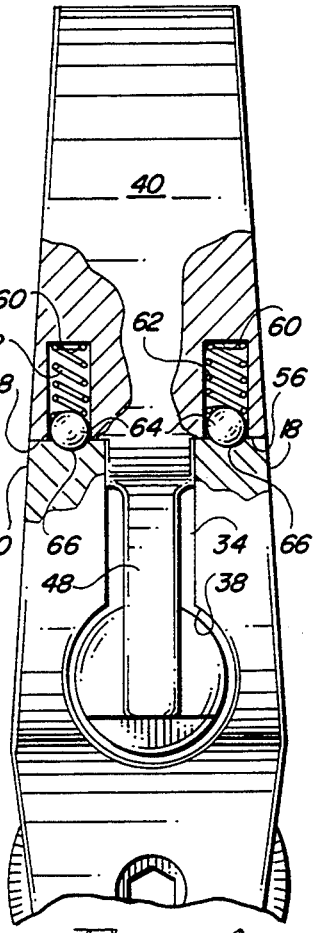
FIG. 4 is an additional detailed view in partial section and cutaway of various components of the head portion of the subject wrench assembly.

Additionally included as part of the adjustable wrench is a sliding secondary jaw 40. The sliding secondary jaw 40 includes a sliding grasping face 42 having an upper segment 44 and a lower segment 46. The upper segment 44 and lower segment 46 of the sliding grasping face 42 are angled with relation to one another and are disposed such that the angled orientation therebetween is substantially the same as the angled orientation between the distal segment 24 and the proximal segment 26 of the fixed grasping face 22. Further, the upper segment 44 of the sliding grasping face 42 is disposed so as to be substantially parallel with the distal segment 24 of the fixed grasping face 22, thereby facilitating grasping of objects therebetween. The lower segment 46 of the sliding grasping face 42 is substantially narrower than the upper segment 44 of the sliding grasping face 42. The lower segment 46 is narrower such that it may be slidingly disposed between the spaced parallel track segments 27 and 29 of the head portion 14. Extending tangentially from the lower segment 46 of the sliding grasping face 42 and integrally formed as part of the sliding secondary jaw 40 is an elongate gear member 48. The gear member 48 is substantially cylindrical and is axially and slidingly disposed within the lower cylindrical portion 38 of the central channel 34 such that sliding of the gear member 48 within the central channel 34 will result in corresponding sliding of the secondary jaw 40 along the track segments 18 and 20. Disposed on a lower surface of the gear member 48 are a plurality of gear teeth 50. These gear teeth 50 are adapted to be engaged by a worm gear 52 disposed within the head portion 14. The worm gear 52 is rotatably positioned within the head portion 14 such that the teeth 54 of the worm gear 52 will engage the gear teeth 50 of the gear member 48 within the central channel 34. The worm gear 52 is positioned so as to protrude from the head portion 14 on opposite sides thereof (see FIG. 4) thereby facilitating rotation thereof by a thumb or finger of a user. Rotation of the worm gear 52 is adapted to result in direct and corresponding sliding movement of the sliding secondary jaw 40 along the spaced parallel track segments 18 and 20 thereby facilitating positioning of the sliding secondary jaw 40 at a desired predetermined position along the track segments 18 and 20, the desired position relating to the spacing between the fixed primary jaw 16 and sliding secondary jaw 40 with relation to the item to be grasped therebetween. The wider upper segment 44 of the sliding grasping face 42, as a result of the wider size, includes a pair of parallel jaw slide faces 56 and 58 disposed along opposite sides of the lower segment of the sliding grasping face. The jaw slide faces 56 and 58 are adapted to slidingly and matingly confront the upper slide faces 30 and 32 of the parallel track segments 18 and 20 respectively, thereby maintaining the necessary orientation of the sliding secondary jaw 40 as it moves along the spaced parallel track segments 18 and 20.

Positioned within at least one but possibly both of the jaw slide faces 56 or 58 of the sliding secondary jaw 40 is a vertical bore 60. The vertical bore or bores 60, which may be formed therein during initial casting of the adjustable wrench extends through the jaw slide face 56 and/or 58 into the sliding secondary jaw 40 itself. Positioned within each of the vertical bores 60 is a vertical spring 62. The vertical spring 62 is positioned such that it is necessarily compressed between the inner surfaces of the vertical bores and a ballbearing 64. Formed within a corresponding upper slide face 30 and/or 32 of the parallel track segments are a plurality of spaced recesses 66. The spaced recesses 66 are disposed along the upper slide face 30 and/or 32 at spaced predetermined distances from one another, the spaced predetermined distances corresponding a desired position of the sliding secondary jaw 40 relative to the fixed primary jaw 14. These spaced recesses 66 may be positioned so as to correspond a Metric or English unit scale wherein standard fractional units of spacing between the fixed primary jaw and sliding secondary jaw are set. Additionally, the ballbearing 64 is disposed between the vertical spring and the corresponding upper slide face of the parallel track segments. The ballbearing is positioned such that an outwardly biasing force is exerted by the spring 62 on the ballbearing 64, thereby consistently pushing the ballbearing 64 toward the upper slide face 30 and/or 32 of the parallel track segments 18 and 20. Accordingly, upon sliding of the sliding secondary jaw 40 along the parallel track segments 18 and 20, the ballbearing 64 will be urged partially into one of a plurality of recesses 66 upon positioning of the vertical bore 60 directly atop the recess 66. Due to the urging of the ballbearing 64 into one of the recesses 66, the ballbearing 64 is removably locked therein so as to facilitate the designation of the desired positioning of the sliding secondary jaw 14. This removable locking can be disengaged by further turning the worm gear 52, however, the entry of the ballbearing 64 into one of the recesses will be substantially noticeable to the touch during rotation of the worm gear 52. Because the engagement is noticeable to the touch of a user, a user who is merely familiar with the standardized dimensions set by the recesses will be able to easily adjust the wrench 10 without directly and visually referring to the set spacing. So as to facilitate visual positioning, the adjustable wrench 10 also includes indicia disposed on an outer surface of the head portion 14 along one of the parallel track segments, the indicia indicating the desired spacing between the fixed primary jaw 16 and sliding secondary jaw 40. Additionally, the indicia may be located on both sides of the head portion 14 as it is not necessary for the ballbearing 64 to be engaged within one of the recesses 66 for the wrench 10 to be effectively utilized. As an additional, and highly important feature, the urging of the ballbearing 64 into one of the recesses 66 by the vertical spring 62 will result in a substantially audible sound being made. This substantially audible sound is highly important so as to signal to a user that the ballbearing 64 has been engaged into a corresponding recess. Such an audible signal is of particular importance if a user is wearing gloves or cannot otherwise feel the locked engagement and if the user cannot otherwise visually see the spacing between the fixed primary jaw 16 and the sliding secondary jaw 40.

Now that the invention has been described,

What is claimed is:

1. An adjustable wrench comprising:

a main body, said main body including an elongate handle portion and a head portion, said head portion including a fixed primary jaw, said primary jaw including a fixed grasping face having a distal segment and a proximal segment, said head portion further including a pair of spaced parallel track segments extending from said proximal segment of said fixed grasping face, said track segments each including an upper slide face and defining a central channel therebetween, a sliding secondary jaw, said secondary jaw including a sliding grasping face having an upper segment and a lower segment, said lower segment being substantially narrower than said upper segment such that said lower segment is slidably disposed between said track segments, said sliding secondary jaw further including an elongate gear member extending tangentially from said lower segment of said sliding grasping face and being axially and slidingly disposed within said central channel such that sliding of said gear member within said channel results in corresponding sliding of said secondary jaw along said track segment, thereby positioning said sliding secondary jaw a desired distance from said fixed primary jaw, said gear member including a plurality of gear teeth, a worm gear disposed within said head portion, said worm gear being structured and disposed to engage said gear teeth on said gear member such that rotation of said worm gear results in corresponding axial movement of said gear member within said central channel, said wider upper segment of said sliding grasping face including a pair of parallel jaw slide faces disposed on opposite sides of said lower segment of said sliding grasping face, said jaw slide faces slidingly and matingly confronting said upper slide faces of said parallel track segments, a vertical bore extending through at least one of said jaw slide faces into said sliding secondary jaw, a vertical spring disposed within said vertical bore, a plurality of spaced recesses disposed along a corresponding one of said upper slide faces of said parallel track segments, said recesses being spaced predetermined distances from one another, and a ballbearing disposed between said vertical spring and said corresponding one of said upper slide faces of said parallel track segments, said spring exerting an outwardly biasing force on said ballbearing such that upon positioning of said vertical bore atop one of said spaced recesses, said ballbearing is urged partially into said one recess thereby resulting in removable locked engagement of said ballbearing within said one recess and a substantially audible sound being made so as to signal locked engagement at one of said plurality of recesses.

2. An adjustable wrench as recited in claim 1 wherein said head portion includes indicia thereon, said indicia corresponding said desired distance between said fixed primary jaw and said sliding secondary jaw.

3. An adjustable wrench as recited in claim 2 wherein said predetermined distances between said recesses corresponds said desired distance between said fixed primary jaw and said sliding secondary jaw in integrals of fractions of an inch.

4. An adjustable wrench as recited in claim 2 wherein said predetermined distances between said recesses corresponds said desired distance between said fixed primary jaw and said sliding secondary jaw in integrals of metric fractions.

5. An adjustable wrench as recited in claim 1 wherein a vertical bore is formed in each of said jaw slide faces in equivalent locations within said sliding secondary jaw, a vertical spring disposed within each of said vertical bores, a plurality of recesses having a predetermined spacing therebetween being disposed along each of said upper slide faces of said parallel track segments, a ballbearing disposed within each of said bores in biased engagement with a corresponding vertical spring, said ballbearings biased into movable engagement with upper slide faces of said parallel track segments.

6. An adjustable wrench as recited in claim 5 wherein said vertical springs and corresponding ballbearings are cooperatively structured to removably dispose said ballbearings concurrently into correspondingly positioned ones of said recesses when said vertical bores and said recesses are in axial alignment with one another and thereby define a removable locked engagement of said ballbearings within said recesses.

7. An adjustable wrench as recited in claim 6 wherein said ballbearings and plurality of recesses are cooperatively structured and disposed to provide a sound when mutually engaged thereby defining an audible signal of locked engagement between said ballbearings and said recesses.

* * * * *